United States Patent [19]

Stoddard

[11] 4,205,695

[45] Jun. 3, 1980

[54] AIRPLANE SHELTER

[75] Inventor: Helen E. Stoddard, Patagonia, Ariz.

[73] Assignees: David Stoddard; Elizabeth Stoddard, both of Scottsdale, Ariz.

[21] Appl. No.: 921,967

[22] Filed: Jul. 5, 1978

[51] Int. Cl.[2] ..... A45F 1/06

[52] U.S. Cl. ..... 135/1 R

[58] Field of Search ..... 135/1 R, 1 A, 1 C, 1 D, 135/3 A, 5 A, 5 R; 244/1

[56] References Cited

U.S. PATENT DOCUMENTS

| | | | |
|---|---|---|---|
| 1,342,234 | 6/1920 | Smith | 135/1 R |
| 1,825,183 | 9/1931 | Frisby | 135/1 A |
| 2,723,811 | 11/1955 | Blomquist | 135/1 A |
| 3,621,858 | 11/1971 | Steele | 135/1 R |
| 3,822,813 | 7/1974 | Carter | 135/1 R |

*Primary Examiner*—Reinaldo P. Machado

*Attorney, Agent, or Firm*—Harry M. Weiss

[57] ABSTRACT

A recreational or emergency shelter for use with a small aircraft includes an upper panel particularly adapted for connection to the wing tip of the aircraft. The shelter is a lightweight material which may be compactly folded for storage on the aircraft.

10 Claims, 3 Drawing Figures

AIRPLANE SHELTER

BACKGROUND OF THE INVENTION

1. Field of the Invention

This invention relates to shelters for recreational or emergency use, and, more particularly, to such shelters for use with small aircraft.

2. Description of the Prior Art

Many emergency and recreational shelters have been provided for various purposes. Since the widespread use of station wagons, there have been many suggested types of lean-to shelters for affixing thereto. With the rapidly expanding use of private aircraft, there is a need for shelters particularly adopted therewith. However, an aircraft ordinarily is not of a size such that a lean-to shelter of the type required for station wagons is appropriate. Also, in general, the station wagon shelter is only for recreational purposes and hence need only be carried in the vehicle when it is intended to use the shelter for that purpose. Thus, in connection with a shelter for use with small aircraft, it is necessary that it be lightweight so that it can become part of the emergency equipment and carried at all times therein. Obviously, it is thus always available for leisure use as well.

SUMMARY OF THE INVENTION

It is an object of this invention to provide an emergency and recreational shelter for use with small aircraft.

A further object of the invention is to provide shelter which is particularly adapted to be connected to and supported by the wing tip of an airplane.

A still further object of the invention is to provide an emergency and recreational shelter for use with aircraft which is lightweight and compact.

In accordance with these objects there is provided an airplane shelter having protective textile material panels forming an enclosure and a top panel substantially covering said enclosure. The top panel includes means for connecting said panel to an airplane wing and retaining said protective panels substantially in an erect position.

One of the protective panels is formed with an entrance opening and has secured thereto a flap of textile material and a flap of netting material.

Another of the panels has a similarly flap-covered window opening. The means for retaining the top panel to the plane may be elastic material, a drawstring, or a tube of textile material adapted for insertion surrounding the wing tip.

The airplane shelter textile material is a lightweight synthetic material such as rayon.

BRIEF DESCRIPTION OF THE DRAWING

Further objects and advantages of the invention will be understood from the following complete description thereof and from the drawings wherein.

COMPLETE DESCRIPTION

As aforestated, many emergency and recreational shelters have been provided for various purposes. Since the widespread use of station wagons, there have been many suggested types of lean-to shelters for affixing thereto. With the rapidly expanding use of private aircraft, there is a need for shelters particularly adopted therewith. However, an aircraft ordinarily is not of a size such that a lean-to shelter of the type required for station wagons is appropriate. Also, in general, the station wagon shelter is only for recreational purposes and hence need only be carried in the vehicle when it is intended to use the shelter for that purpose. Thus, in connection with a shelter for use with small aircraft, it is necessary that it be lightweight so that it can become part of the emergency equipment and carried at all times therein. Obviously, it is thus always available for leisure use as well.

Figure 1:
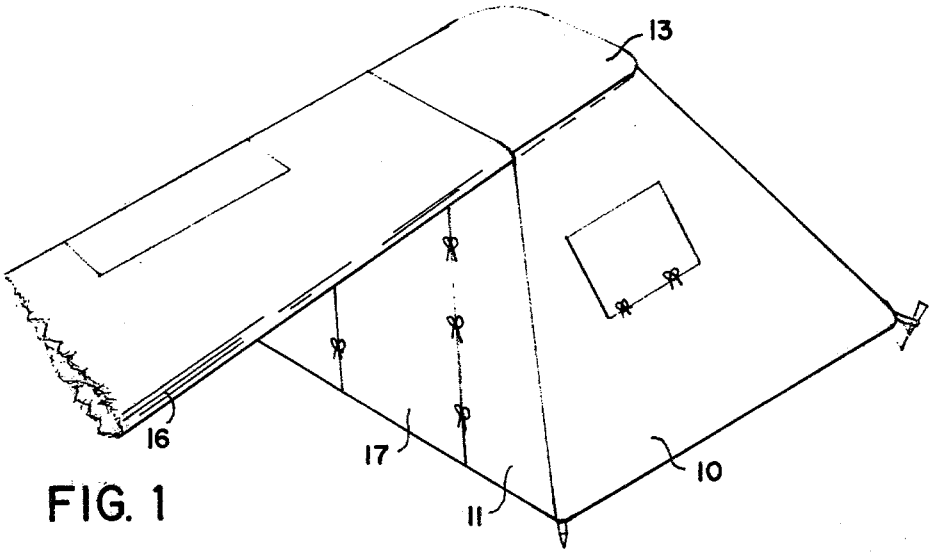
FIG. 1 is a perspective view of a shelter in accordance with the invention erected for use.

As shown in FIG. 1, an airplane shelter is provided including protective textile material panels 10 and 11 forming an enclosure 12 (see FIG. 3) and a top panel 13 substantially covering the enclosure. The top panel 13 includes means 14 (a sleeve of material) (FIG. 3) for inserting an airplane wing 16 and retaining said protective panels substantially in an erect position.

Figure 3:
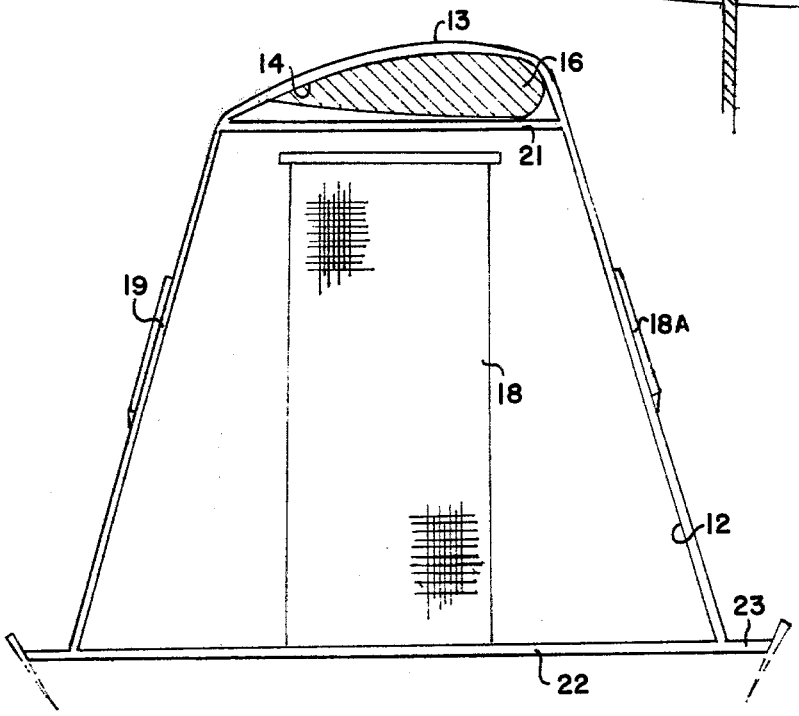
FIG. 3 is an enlarged cross-sectional view depicting a further embodiment of the invention.

The illustrations of FIGS. 1 and 3 depict a recreational or emergency shelter having a floor panel 22, side panels 10 and 11 forming an enclosure 12 and a ceiling panel 21. An additional top panel 13 is spaced from ceiling panel 21 and secured to side panels 10 and 11 so as to form a sleeve or tube-like enclosure 14 to accommodate the wing tip of an airplane. When the wing tip is inserted into enclosure 14 (also referred to herein as insertion means 14) the upper surface of the wing provides the necessary support to retain side panels 10 and 11 in a substantially erect position.

The airplane shelter has one of the protective panels 11 formed with an entrance opening covered by a flap 17 of textile material and a flap 18 (see FIG. 3) of netting material.

Figure 2:
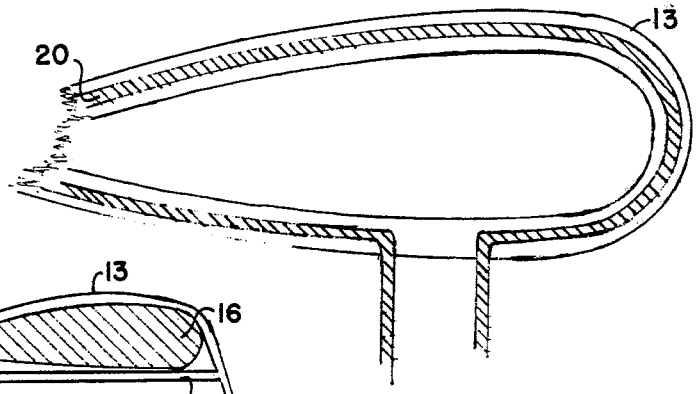
FIG. 2 is a cross-sectional view of an airplane wing with one fastening method for the shelter of FIG. 1.

The others of said panels 10 have similarly flap-covered window openings 18A and 19 (see FIG. 3). The insertion means 14 may be of elastic material, include a drawstring 20 (see FIG. 2) or, preferably be, a sleeve (see FIG. 3) of textile material adapted for insertion of and surrounding the wing tip 16. Drawstring 20, illustrated in FIG. 2 provides additional means for securing sleeve 14 to wing 16. As indicated in FIG. 2, top panel 13 and ceiling panel 21 are extended and hemmed so as to form a casing through which drawstring 20 is passed. The structure of drawstring closures is familiar in the prior art. Drawstring 20 passes completely about wing 16 and its ends are brought forth through openings in the casing formed in top panel 13 and ceiling panel 21. When these ends are drawn out fully and knotted securely, enclosure 14 will be secured to wing 16 inserted therein.

As with conventional shelters, it includes a bottom panel 22 forming a ground cover and further including tiedown 23 at the periphery of the bottom panel 22. The textile material is a lightweight synthetic material such as rayon.

SUMMARY OF THE INVENTION

Thus, it will be seen that there is provided an emergency and recreational shelter for use with small aircraft which is particularly adapted to be connected to and supported by the wing of an aircraft.

The emergency and recreational shelter for use with the aircraft is lightweight and compact.

While the invention has been particularly shown and described in reference to the preferred embodiment thereof, it will be understood by those skilled in the art that suitable modification may be made therein without departing from the spirit and scope of the invention.

What is claimed is:

1. A shelter attachable to an airplane comprising protective material panels forming an enclosure and a top panel substantially covering said enclosure, said top panel including means for covering an end portion of an airplane wing and bearing on at least a portion of the surface of said wing to retain said protective panels substantially in an erect position.

2. A shelter as recited in claim 1 wherein one of said protective panels is formed with an entrance opening and has secured thereto a flap of textile material and a flap netting material.

3. A shelter as recited in claim 2 wherein another of said panels has a similarly flap-covered window opening.

4. A shelter as recited in claim 1 and further including a bottom panel forming a ground cover.

5. A shelter as recited in claim 4 and further including tiedown at the periphery of the bottom panel.

6. A shelter as recited in claim 5 wherein said textile material is a lightweight synthetic material.

7. A shelter as recited in claim 6 wherein said material is rayon.

8. The shelter as recited in claim 1 wherein said means for covering said wing is of elastic material.

9. The shelter as recited in claim 1 wherein said means for covering said wing further comprises a drawstring.

10. The shelter as recited in claim 1 wherein said covering means is a sleeve of material adapted for surrounding an airplane wing therein.

* * * * *